US005440284A

United States Patent [19]

Ferullo et al.

[11] Patent Number: 5,440,284

[45] Date of Patent: Aug. 8, 1995

[54] INDUSTRIAL-RATED CIRCUIT BREAKER HAVING UNIVERSAL APPLICATION

[75] Inventors: David A. Ferullo, Farmington; Roger J. Morgan, Simsbury; James L. Rosen, West Hartford; Donna DeRosier, Bristol; Roger N. Castonguay, Terryville, all of Conn.

[73] Assignee: General Electric Company, New York, N.Y.

[21] Appl. No.: 258,317

[22] Filed: Jun. 10, 1994

Related U.S. Application Data

[62] Division of Ser. No. 85,496, Jul. 2, 1993, Pat. No. 5,361,052.

[51] Int. Cl.[6] ..... H01H 9/02

[52] U.S. Cl. ..... 335/202; 335/201; 218/1

[58] Field of Search ..... 335/202, 6, 201; 200/293, 295, 303, 304, 305, 306, 307, 144 R, 147 R

[56] References Cited

U.S. PATENT DOCUMENTS

| | | | |
|---|---|---|---|
| 534,191 | 8/1894 | Crookston et al. | 335/16 |
| 4,345,223 | 8/1982 | Chien-Chun | 335/2 |
| 4,760,364 | 7/1988 | Ostby | 335/132 |

*Primary Examiner*—Lincoln Donovan
*Attorney, Agent, or Firm*—Richard A. Menelly

[57] ABSTRACT

A molded case circuit breaker enclosure and operating components are provided with additional features to enable compliance with a variety of international electrical requirements for sales in the world market. The circuit breaker operating handle is prevented from returning to the OFF position upon contact welding as one example. Another modification includes a reinforcement and rejection pin used with the enclosure case. A further modification includes a shield used with the movable contact arm to prevent the arc gas contaminants from contacting the circuit breaker operating springs.

4 Claims, 7 Drawing Sheets

INDUSTRIAL-RATED CIRCUIT BREAKER HAVING UNIVERSAL APPLICATION

This is a divisional of application Ser. No. 08/085,496, filed Jul. 2, 1993 now U.S. Pat. No. 5,361,052.

BACKGROUND OF THE INVENTION

U.S. Pat. No. 4,754,247 entitled "Molded Case Circuit Breaker Accessory Enclosure" describes a so-called "integrated" circuit breaker that provides both circuit interruption as well as accessory function. This Patent should be reviewed for its disclosure of an accessory cover mounted on the circuit breaker cover for providing access to field-installable accessory devices. The integrated circuit breaker includes an integrated circuit electronic trip unit which allows one circuit breaker design to be used over a wide range of ampere ratings in combination with a rating plug, also mounted in the circuit breaker cover. The electronic trip unit is described within U.S. Pat. No. 4,589,052 and the rating plug is described within U.S. Pat. No. 4,649,455.

Introduction of such integrated circuit breakers within the world market has raised some interesting considerations with regard to the various and sundry International Electrical standards which cover most of the European and Asian countries.

The use of common circuit breaker components over a wide variety of International-listed ampere ratings could produce a strain on the circuit breaker cover in the vicinity of the arc chute when a lower rated circuit breaker cover is used with a higher rated circuit breaker operating mechanism.

International electric standards require that the circuit breaker handle remain in the ON position when the circuit breaker contacts are welded together and an attempt is made to reset the circuit breaker operating mechanism.

The addition of the fourth circuit breaker pole to commonly employed U.S. manufactured three pole industrial-rated circuit breakers further increases the amount of gaseous products produced during circuit interruption under severe overcurrent test conditions.

The purpose of the invention is to provide several adaptations to the integrated circuit breaker described earlier that would render the circuit breaker useful in any of the countries subscribing to the International Electric Code without requiring a complete and separate circuit breaker design for both the U.S. and foreign markets.

SUMMARY OF THE INVENTION

The invention comprises a molded case circuit breaker configured for sales in the world market. A rejection and reinforcement pin arrangement between the circuit breaker cover and case prevents mismatching between the covers and cases used for various U.S. and International ratings while adding to the overall mechanical strength of the circuit breaker enclosure. A separate operating handle return spring cooperates with the circuit breaker operating mechanism to insure that the operating handle returns to the ON position upon the occurrence of contact welding. An additional contact spring shield fitted to the movable contact carrier ensures that the contact springs within each pole are protected against arc gas contamination.

DESCRIPTION OF THE PREFERRED EMBODIMENT

Figure 1:
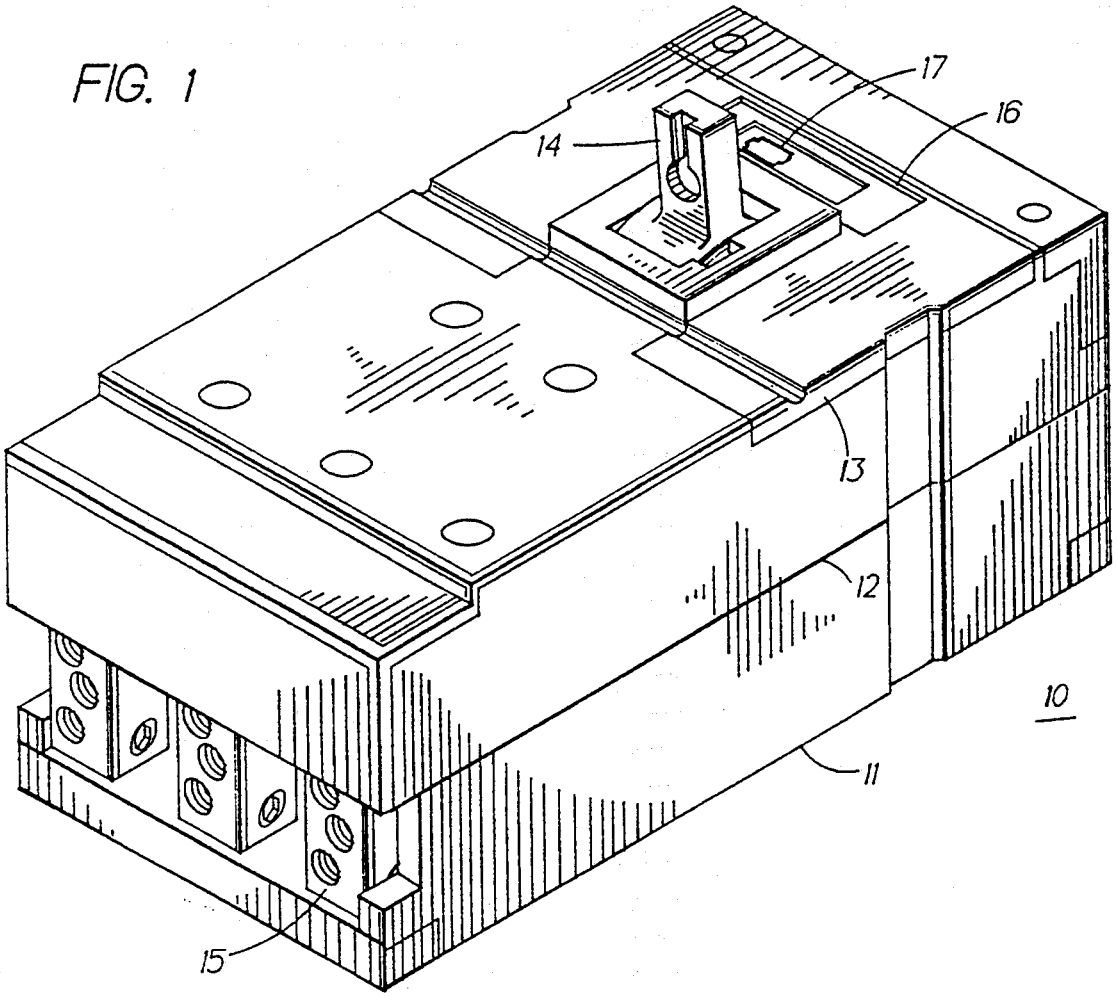
FIG. 1 is a top perspective view of a molded case circuit breaker containing features that enable sales in the world market.

An integrated circuit breaker 10 is shown in FIG. 1 and consists of a molded plastic case 11 to which a molded plastic cover 12 is attached. An accessory cover 13 as described in the aforementioned U.S. Pat. No. 4,754,247 is arranged on the top of the cover around the circuit breaker operating handle assembly 14. The electronic trip unit 16 is arranged within the circuit breaker cover 12. The rating plug 17 is also accessible from the circuit breaker cover to allow the ampere rating of the circuit breaker to be adjusted as described within aforementioned U.S. Pat. No. 4,649,455. Electrical connection with an industrial power distribution circuit is made by means by the line terminal lugs 15 that are arranged at the line terminal end of the case 11. Similar load terminal lugs 23 are arranged at the load end of the case as best seen by referring now to the case 11 depicted in FIG. 2.

Figure 2:
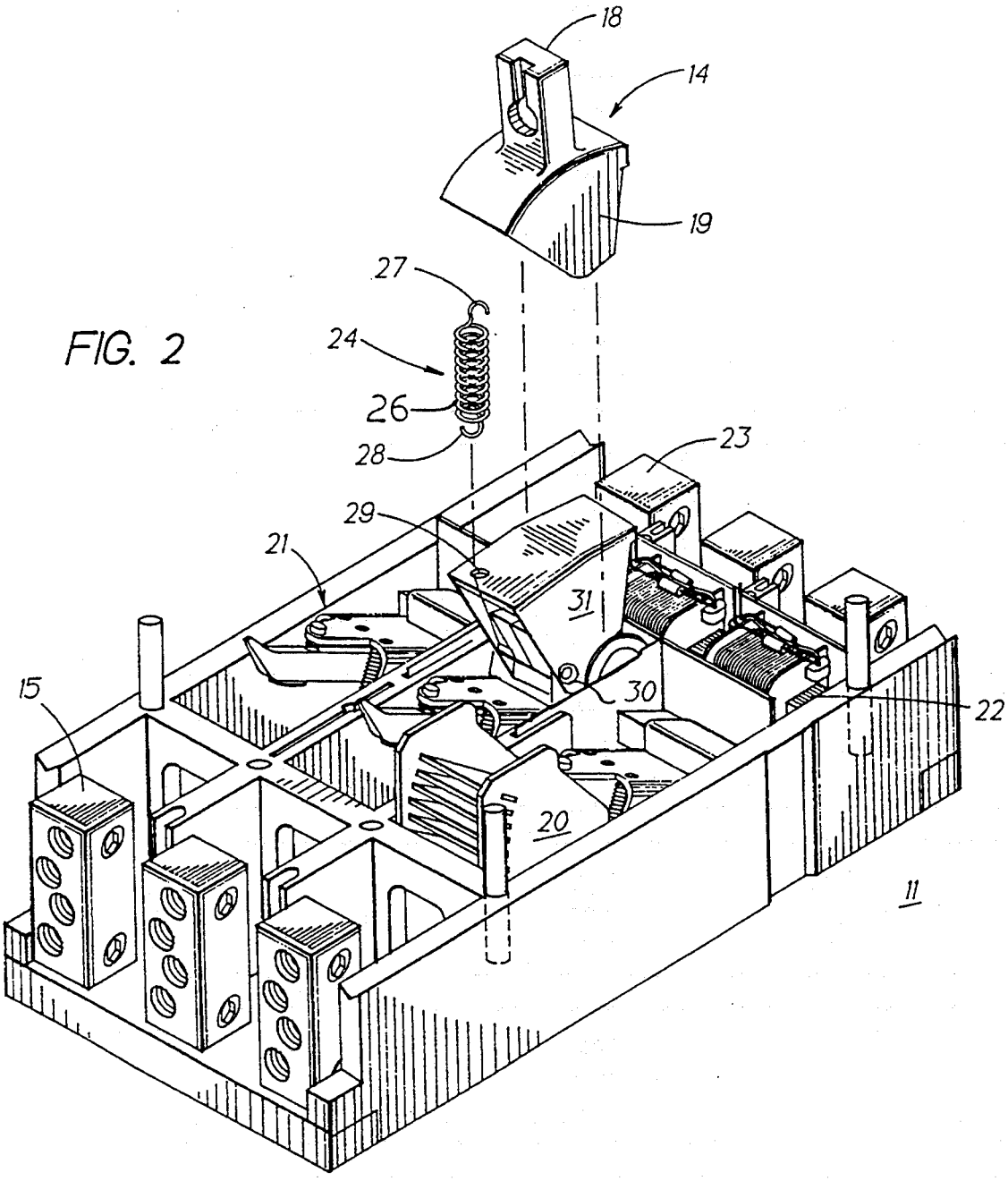
FIG. 2 is a top perspective view of the circuit breaker of FIG. 1 prior to assembly of the circuit breaker cover, handle and handle return spring.

The circuit breaker 10 is depicted in FIG. 2 with the cover removed to show the circuit breaker operating mechanism 21 which is described in U.S. Pat. No. 5,004,878. The arc chutes 20 are arranged at one end of the operating mechanism while the current transformers 22 are positioned on the opposite end proximate the load lugs 23. In accordance with one feature of the invention, a handle return spring 24 is inserted between the handle assembly 14 and the operating mechanism 21. The handle assembly is formed as a single unit having an upwardly extending handle post 18 and a handle skirt 19 at a bottom thereof. The handle return spring 24 consists of a coiled body 26 with a bottom hook 28 arranged for attaching to the trip pin 30 on the operating mechanism 21 and a top hook 27 arranged for attaching to the hole 29 within the top 31 of the handle yoke portion of the operating mechanism.

Figure 3A:
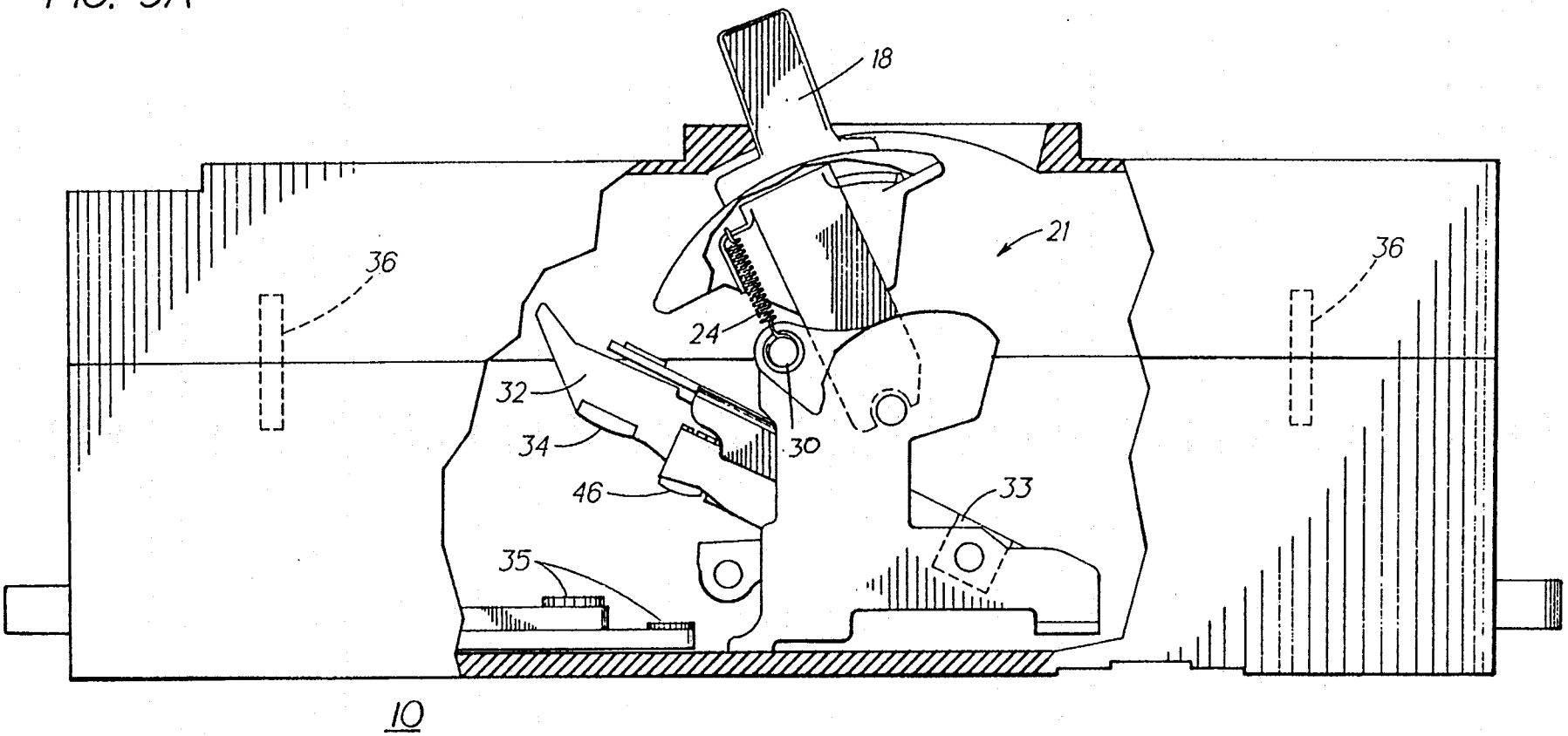
FIG. 3A is a side view of the circuit breaker of FIG. 1 depicting the circuit breaker contacts in a welded closed condition and the operating handle in a TRIPPED position.
Figure 3B:
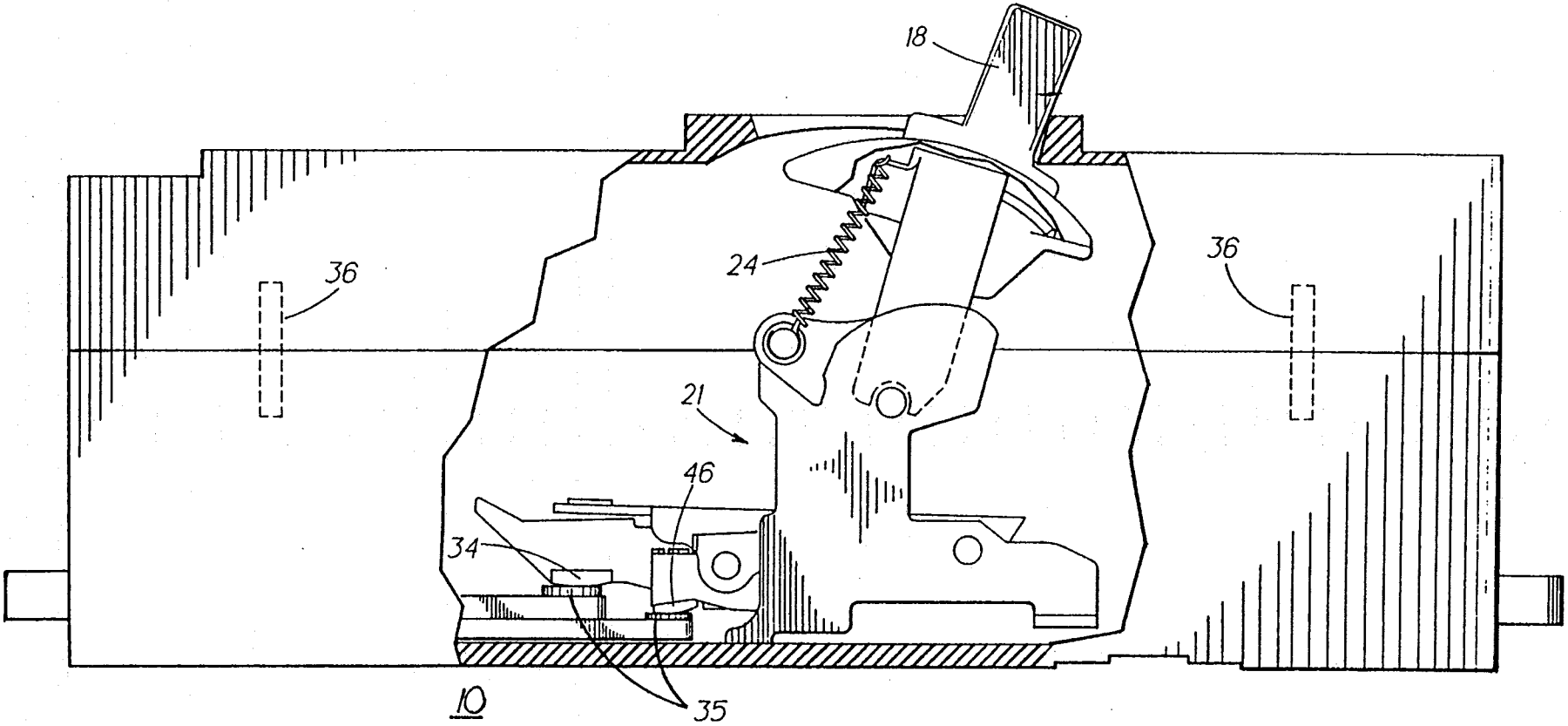
FIG. 3B is a side view of the circuit breaker of FIG. 1 depicting the circuit breaker contacts in a welded closed condition and the operating handle in a RESET position.

The operation of the handle return spring is seen by referring to both FIGS. 3A and 3B. The circuit breaker 10 is depicted in FIG. 3A with the operating mechanism 21 interacting with the movable contact arm 32 by means of a crossbar 33. The movable contact 34 is shown welded to the fixed contact 35 and the handle post 18 is in the ON position. The handle return spring 24 is in its unbiased condition extending between the top of the operating mechanism and the trip pin 30. When an attempt is made to reset the operating mechanism, the handle post 18 is moved to the position shown in FIG. 3B which extends the handle return spring 24. The operating mechanism cannot become reset because of the welded attachment between the fixed and movable contacts 35, 34. When the handle post is then released, the handle post immediately returns to the ON position indicated in FIG. 3A. The operator is thereby shown that the contacts are welded together and that the associated electric equipment may still remain energized.

Figure 4:
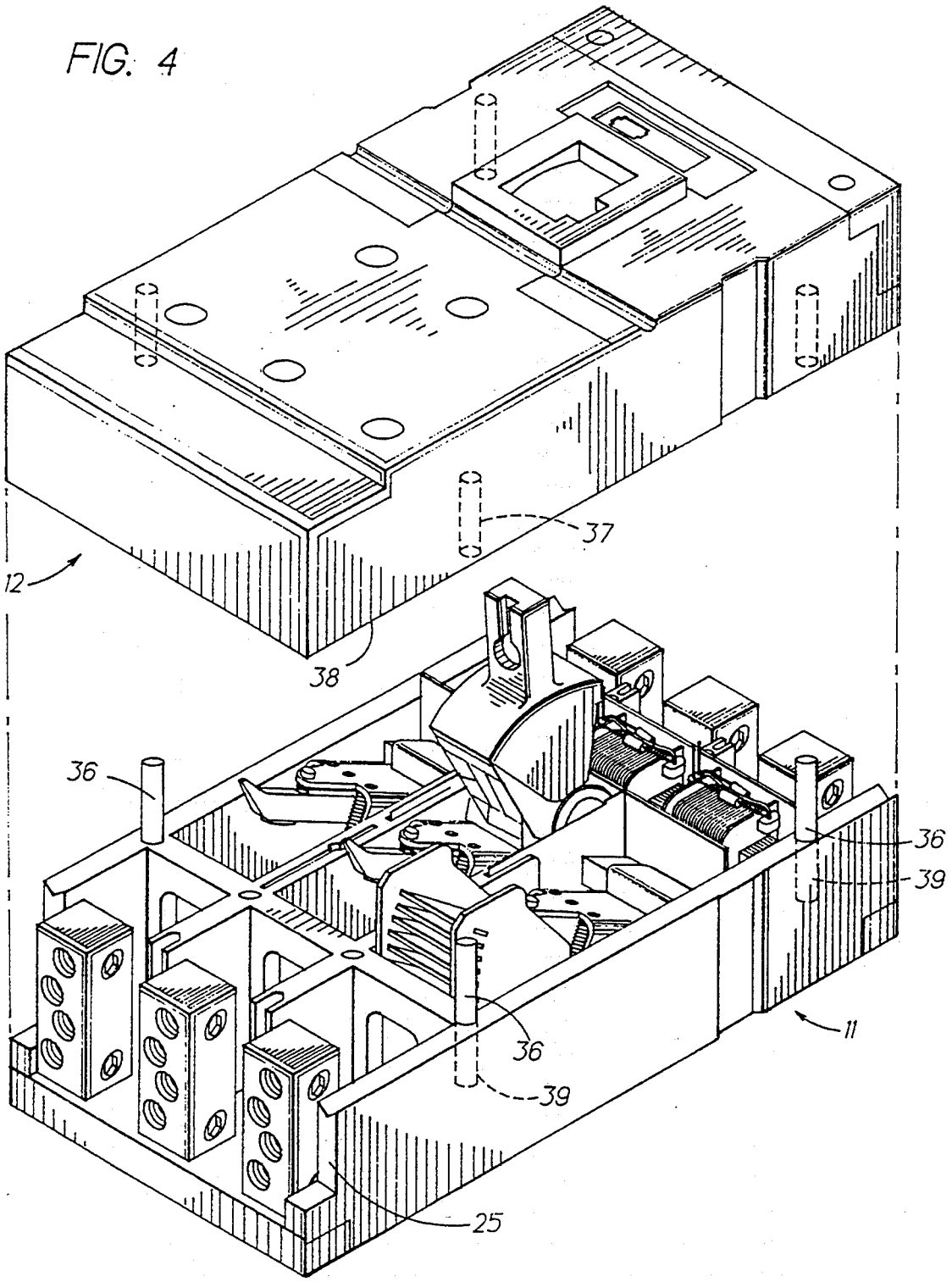
FIG. 4 is a top perspective view of the circuit breaker of FIG. 1 prior to assembly of the circuit breaker cover to depict the reinforcement-rejection pins.

Another feature of the invention is shown in FIG. 4 where steel pins 36 are arranged selectively within the side walls 25 of the circuit breaker case 11. The pins 36 are inserted within cavities 39 formed within the sidewalls and corresponding cavities 37 are formed within the sidewalls 38 of the cover 12. The number and position of the pins and cavities selectively allow certain covers to become attached to certain cases. Since the materials used to form circuit breaker covers and the additives used therein vary for the different ampere ratings, it is conceivably possible that a lower-rated cover may become attached to a higher-rated case. The pins are now arranged within predetermined cavities within the case which align with corresponding cavities within the cover to insure proper match between the cases and covers for all ampere ratings. The pins also substantially improve the mechanical resistance properties of the cover and case to the forces generated within the circuit breaker enclosure during intense overcurrent conditions. An additional feature of the invention is the guiding function the pins provide when the cover is slightly blown upwards away from the case upon such overcurrent occurrence. The slight separation between the case and cover allows the internal gas pressure to become relieved and prevent damage to the enclosure. In the absence of the pins, the cover could become slightly off-set from the case and then insufficiently seal the circuit breaker interior when the cover returns to tight contact with the case after the internal gas pressure has vented.

Figure 5:
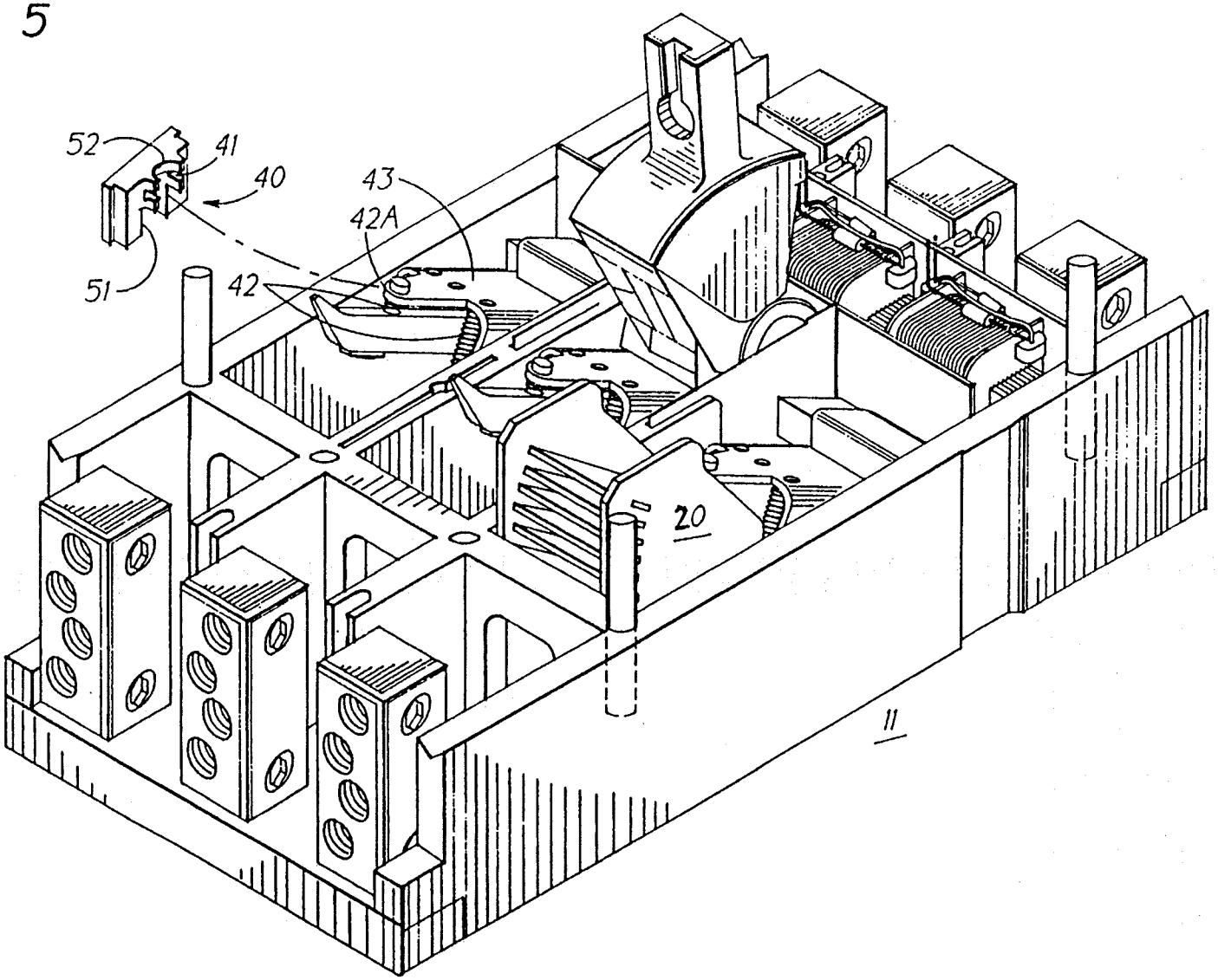
FIG. 5 is a top perspective view of the circuit breaker of FIG. 1 prior to assembly of the circuit breaker cover to depict the contact spring shields.

To prevent contamination damage to the contact springs 42 supported on the contact carriers 43 shown in FIG. 5, during such intense circuit interruption, a contact spring shield 40 is arranged on the front end 42A of the contact carrier 42. The shield is cast from a high temperature plastic material such as nylon or a high temperature fiber material such as wollastonite to resist the high temperatures generated within the arc chutes 20 during the interruption process. The bottom slot 51 encompasses part of the contact arm carrier while the top radial slot 52 assists in fastening the shield to the contact carrier. The projections 41 extend from the shield to provide lateral protection to the contact springs.

Figure 6A:
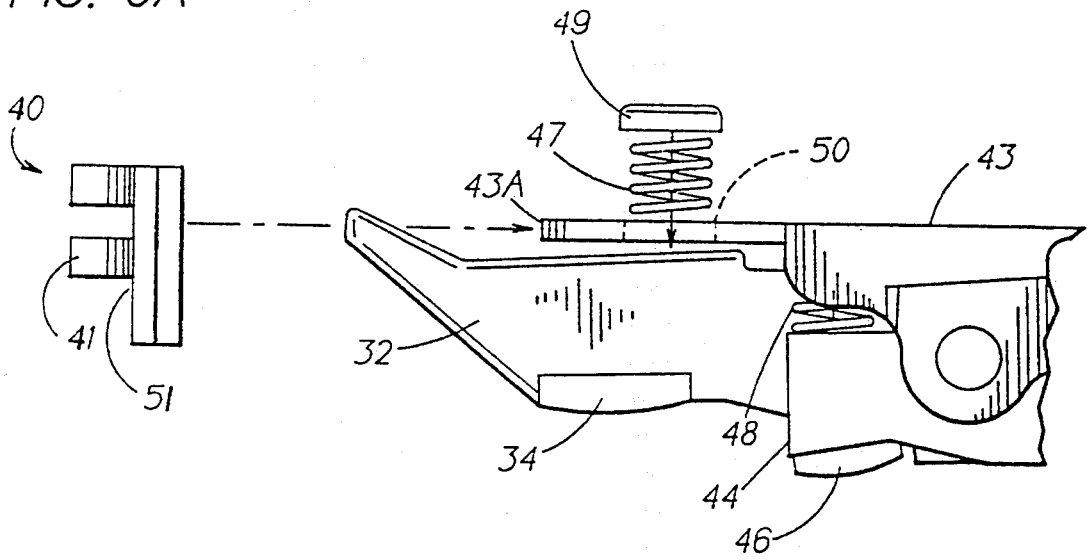
FIGS. 6A and 6B are enlarged cut-away side views of the moveable contact arms within the circuit breaker of FIG. 4 depicting the attachment of the contact spring shields to the movable contact carrier.
Figure 6B:
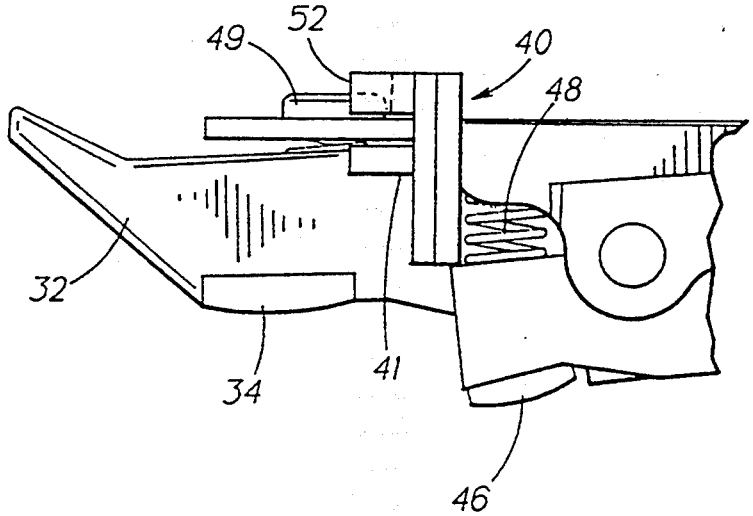

The shield 40 is attached to the contact carrier 43 in the manner shown in FIGS. 6A and 6B where the contact carrier 43 is shown supporting the arcing contact arm 32 with the arcing contact 34 attached to one end and the main contact arms 44 with the main contacts 46 attached to one end. The arcing contact spring 47 is attached to a cap 49 and is inserted through an opening 50 in the contact carrier after the shield 40 is attached to the contact carrier. The main contact springs 48 are trapped between the main contact arms 44 and the contact carrier 43. The shield 40 is positioned on the contact carrier 43 by positioning the bottom slot 51 over the front end 43A and aligning the projections 41 with the main contact springs 48. With the shield attached to the contact carrier, as shown in FIG. 6B, top radial slot 52 is trapped behind the cap 49 which securely attaches the shield 40 to the contact carrier 32 and which positions the projections 41 on the shield alongside the main contact springs 48 for additional protection against arc gas contamination.

A circuit breaker enclosure and components have herein been described which allow the circuit breaker to meet International Electrical Code requirements. The same circuit breaker design can accordingly be sold in both the U.S. and international markets without further modification.

Having thus described our invention, what we claim by Letters Patent is:

1. A universal circuit breaker comprising:

a molded plastic case and cover said case and cover each comprising a rectangular perimeter having a plurality of cavities formed therein;

a pair of separable contacts within said case;

an operating mechanism within the case arranged for separating said contacts and interrupting circuit current upon the occurrence of an overcurrent condition within a protected electric circuit;

a handle operator extending through said cover for manual operation of said operating mechanism to reset said operating mechanism after cessation of said overcurrent condition; and a plurality of pins within said cavities in said case arranged for insertion within said cavities formed within said cover, said pins and said cavities corresponding to particular circuit breaker ampere ratings to thereby allow attachment of selected covers to selected cases corresponding to selected circuit breaker ampere ratings.

2. A universal circuit breaker comprising:

a molded plastic case and cover;

a first movable contact arm within said case carrying a first movable contact at one end and interacting with an operating mechanism for moving in and out of abutment with a first fixed contact, said first movable contact being biased into abutment with said first fixed contact by a first contact spring;

an arc chute proximate said first fixed and movable contacts for cooling and quenching an electric arc when said first fixed and movable contacts are separated during overcurrent conditions;

a shield intermediate said first contact spring and said arc chute preventing contaminants from said arc from contacting said first contact spring;

a second movable contact arm within said case carrying a second movable contact at one end and interacting with said operating mechanism for moving in and out of abutment with a second fixed contact, said second movable contact being biased into abutment with said second fixed contact by a second contact spring, said shield preventing said contaminants from contacting said second contact spring.

3. The universal circuit breaker of claim 2 wherein said first movable contact comprises a main contact.

4. The universal circuit breaker of claim 2 wherein said second movable contact comprises an auxiliary contact.

* * * * *